US009551512B2

(12) United States Patent
Ko et al.

(10) Patent No.: US 9,551,512 B2
(45) Date of Patent: Jan. 24, 2017

(54) AIR CONDITIONING SYSTEM

(75) Inventors: Young Hwan Ko, Changwon-si (KR); Bum Suk Kim, Changwon-si (KR); Man Ho Chun, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 2198 days.

(21) Appl. No.: 12/155,259

(22) Filed: May 30, 2008

(65) Prior Publication Data

US 2009/0165482 A1 Jul. 2, 2009

(30) Foreign Application Priority Data

Jan. 2, 2008 (KR) ..... 10-2008-0000217
Jan. 2, 2008 (KR) ..... 10-2008-0000218

(51) Int. Cl.
*F25B 13/00* (2006.01)
*F25B 1/10* (2006.01)

(52) U.S. Cl.
CPC ..... *F25B 1/10* (2013.01); *F25B 13/00* (2013.01); *F25B 2341/0662* (2013.01); *F25B 2400/13* (2013.01); *F25B 2400/23* (2013.01); *F25B 2500/19* (2013.01); *F25B 2600/2509* (2013.01); *F25B 2600/2513* (2013.01); *F25B 2700/1931* (2013.01); *F25B 2700/21* (2013.01); *F25B 2700/2104* (2013.01); *F25B 2700/2106* (2013.01); *F25B 2700/21151* (2013.01); *F25B 2700/21152* (2013.01)

(58) Field of Classification Search
CPC ..... F25B 49/00; F25B 2400/053; F25B 49/02; F25B 2400/0415
USPC ..... 62/160, 196.1, 197, 205, 208–212, 62/222–225, 228.1, 228.5, 498, 510
See application file for complete search history.

(56) References Cited

U.S. PATENT DOCUMENTS 5,046,325 A * 9/1991 Kuwahara ..... 62/156
5,442,926 A * 8/1995 Kawai et al. ..... 62/211
5,916,252 A * 6/1999 Yoshida et al. ..... 62/204
6,044,651 A * 4/2000 Reason ..... B60H 1/3208 62/158
6,854,285 B2 * 2/2005 Jessen ..... 62/225
7,918,097 B2 * 4/2011 Kim ..... F25B 13/00 62/196.1

(Continued)

FOREIGN PATENT DOCUMENTS

EP 0 976 991 A2 2/2000
JP 2004218879 A * 8/2004 ..... F24F 11/02

(Continued)

*Primary Examiner* — M. Alexandra Elve
*Assistant Examiner* — Alexis Cox
(74) *Attorney, Agent, or Firm* — Dentons US LLP

(57) ABSTRACT

An air conditioning system, including a condenser for condensing a refrigerant, a first expansion device for throttling the refrigerant passed through the condenser, a second expansion device for throttling the refrigerant passed through the first expansion device, an evaporator for evaporating the refrigerant passed through the second expansion device, a compressor for compressing the refrigerant passed through the evaporator and the refrigerant injected after branched between the first expansion device and the second expansion device, and a control unit for detecting a value of at least one operating parameter and determining a target opening degree of the first expansion device on the basis of a stored set value corresponding to the detected value of the operating parameter.

3 Claims, 12 Drawing Sheets

(56) References Cited

U.S. PATENT DOCUMENTS

| | | | | |
|---|---|---|---|---|
| 2004/0107715 | A1* | 6/2004 | Lee et al. | 62/223 |
| 2006/0277931 | A1* | 12/2006 | Nakamura et al. | 62/196.1 |
| 2006/0277932 | A1* | 12/2006 | Otake et al. | 62/196.1 |
| 2009/0165481 | A1* | 7/2009 | Ko | F25B 49/005 62/195 |
| 2009/0188265 | A1* | 7/2009 | Ko | F25B 13/00 62/222 |

FOREIGN PATENT DOCUMENTS

| | | | |
|---|---|---|---|
| KR | 10-2007-0074455 | A | 7/2007 |
| KR | 10-2007-0082501 | A | 8/2007 |
| WO | WO 2007/078144 | A | 7/2007 |
| WO | WO 2007/094618 | A | 8/2007 |

* cited by examiner

AIR CONDITIONING SYSTEM

This nonprovisional application claims priority under 35 U.S.C. §119(a) on Patent Application No. 10-2008-0000217 filed in Republic of Korea on Jan. 2, 2008 and No. 10-2008-0000218 filed on Jan. 2, 2008, the entire contents of which are hereby incorporated by reference.

BACKGROUND

1. Field of the Invention

The present invention relates to an air conditioning system, and more particularly, to an air conditioning system, which can improve the performance and stability of the system.

2. Discussion of the Related Art

Generally, an air conditioning system is a device for cooling or heating an indoor space by performing compression, condensation, expansion and evaporation of a refrigerant.

The air conditioning systems are classified into a normal air conditioner including an outdoor unit and an indoor unit connected to the outdoor unit and a multi-type air conditioner including an outdoor unit and a plurality of indoor units connected to the outdoor unit. Moreover, the air conditioning systems are classified into a cooling air conditioner supplying a cool air only to an indoor space by driving a refrigerant cycle in one direction only and a cooling and heating air conditioner supplying a cool or hot air to an indoor space by driving a refrigerant cycle selectively and bi-directionally.

The air conditioning system includes a compressor, a condenser, an expansion valve, and an evaporator. The refrigerant discharged from the compressor is condensed in the condenser, and then expands in the expansion valve. The expanded refrigerant is evaporated in the evaporator, and then sucked into the compressor. IN a cooling operation or heating operation, a gaseous refrigerant is injected into the compressor, thus improving performance.

However, the air conditioning system according to the related art has the problem that the system may become unstable and damage to the compressor or the like may occur if not controlled properly.

SUMMARY OF THE INVENTION

It is an object of the present invention to provide an air conditioning system, which can improve the performance and stability of the system.

The present invention provides an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for compressing the refrigerant passed through the evaporator and the refrigerant injected after between the first expansion device and the second expansion device; and a control unit for detecting a value of at least one operating parameter and determining a target opening degree of the first expansion device on the basis of a stored set value corresponding to the detected value of the operating parameter.

In the present invention, the compressor includes: a first compressing part for compressing the refrigerant passed through the evaporator; and a second compressing part for compressing the refrigerant passed through the first compressing part and the refrigerant injected after branched between the first expansion device and the second expansion device.

In the present invention, the at least one operating parameter may be a plurality of operating parameters, and the plurality of operating parameters may change the target opening degree of the first expansion device independently. The target opening degree of the first expansion device may be determined based on a linear combination of the set values for the operating parameters. Also, the target opening degree of the first expansion device may be determined based on a multiplied value of the set values for the operating parameters.

In the present invention, the set values of some of the operating parameters may be differently set according to the operability of gas injection in which a refrigerant is branched between the first expansion device and the second expansion device and injected into the compressor. The operating parameters include the frequency of the compressor, the indoor temperature and outdoor temperature of the air conditioning system, and the operability of gas injection in which a refrigerant is branched between the first expansion device and the second expansion device and injected into the compressor.

In accordance with another aspect of the present invention, there is provided an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for compressing the refrigerant passed through the evaporator and the refrigerant injected after branched between the first expansion device and the second expansion device; and a control unit for detecting a value of at least one operating parameter and determining a target opening degree of the first expansion device on the basis of a stored set value corresponding to the detected value of the operating parameter and controlling such that a change in opening degree may change according to the opening time of the first expansion device until the opening degree of the first expansion device reaches the target opening degree.

In the present invention, the control unit may perform a change process of changing the opening amount of the first expansion device until the opening degree of the first expansion device reaches the target opening degree and a maintenance process of maintaining a changed opening degree. In at least some of the change process, a change in opening degree may be controlled so as to be changed according to opening time, and in the maintenance process, an opening degree maintenance time may be controlled so as to be changed according to the change in opening degree. The change in opening degree may be preset depending on the difference between the target opening degree and the current opening degree, and the opening amount of the first expansion valve may be controlled based on a combined value of the current opening degree and the change in opening degree. The change in opening degree may be preset so as to be proportional to the difference between the target opening degree and the present opening degree.

In accordance with still another aspect of the present invention, there is provided an air conditioning system, comprising: a condenser for condensing a refrigerant; a first expansion device for throttling the refrigerant passed through the condenser; a second expansion device for throttling the refrigerant passed through the first expansion device; an evaporator for evaporating the refrigerant passed through the second expansion device; a compressor for compressing the refrigerant passed through the evaporator and the refrigerant branched and injected between the first expansion device and the second expansion device; and a control unit for controlling the first expansion device in a first control method and the second expansion device in a second control method different from the first control method.

In the present invention, the compressor includes: a first compressing part for compressing the refrigerant passed through the evaporator; and a second compressing part for compressing the refrigerant passed through the first compressing part and the refrigerant injected by being branched between the first expansion device and the second expansion device.

In the present invention, in the first control method, a value of at least one operating parameter may be detected, and a target opening degree of the first expansion device may be determined on the basis of a stored set value corresponding to the detected value of the operating parameter.

In the present invention, in the second control method, the degree of superheat of the refrigerant may be measured in real time, and the opening degree of the second expansion device may be changed based on the measured degree of superheat until the measured degree of superheat reaches a preset degree of superheat.

In the present invention, the control unit may control the first expansion device in the first control method, and if a value of at least one operating parameter is out of a preset normal operating range, the control unit may control the first expansion device by switching to a safety control method which is different from the first control method. In the first control method, the current opening degree of the first expansion device may be stored in real time, and in the safety control method, the opening amount of the first expansion device may be controlled on the basis of the current opening degree stored in the first control method upon switching from the first control method. In the safety control method, a correction opening degree may be determined based on the operating parameter value, and the opening amount of the first expansion device may be controlled by combining the correction opening degree with the current opening degree stored in the first control method upon switching from the first control method.

In the present invention, if the degree of superheat of the refrigerant is within a preset range of a target degree of superheat, the control unit may perform fuzzy control over the opening amount of the first expansion device by switching from the first control method.

To accomplish the above object of the air conditioning system of the present invention, the first expansion device and the second expansion device playing a different role from each other are controlled in a different control method suitable for each role, thereby improving the performance and stability of the system.

Furthermore, in the present invention, the control method for the first expansion device is differentiated according to the operation state of the air conditioning system, thereby improving the stability of the system.

Furthermore, in the present invention, the intermediate pressure can be adjusted more rapidly and precisely according to the state of the air conditioning system by differentiating the control method for the first expansion device for adjusting the intermediate pressure depending on the degree of superheat of the refrigerant, thereby improving the stability and performance of the system.

Furthermore, in the present invention, the first expansion device is gradually opened by controlling such that a change in opening degree may change according to the opening time of the first expansion device, thereby improving the stability of the system and achieving more stable switching of the control method for the first expansion device.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

An air conditioning system includes general residential cooling air conditioner for performing a cooling operation only, a heating air conditioner for performing a heating operation only, a heat pump type air conditioner for performing both cooling and heating operations, and a multi-type air conditioner for cooling and heating a plurality of indoor spaces. Hereinafter, as one example of the air conditioning system, a heat pump type air conditioner (hereinafter, referred to as "air conditioner") will be described in details.

Hereinafter, embodiments of the present invention will be described below with reference to the accompanying drawings.

Figure 1:
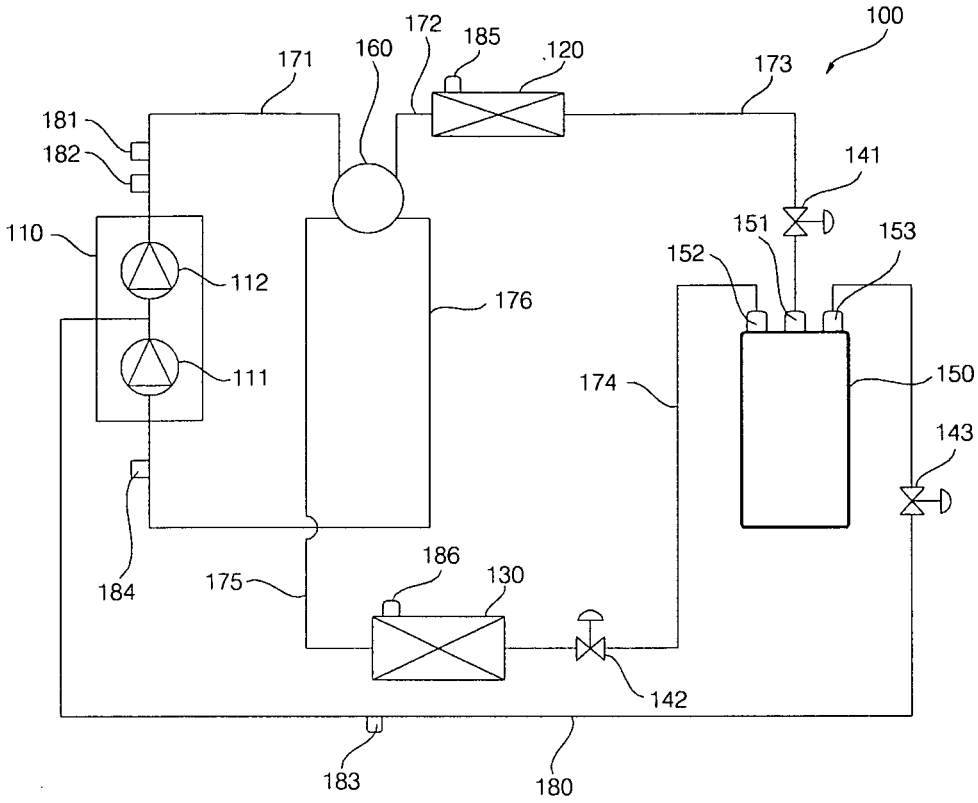
FIG. 1 is a view showing the construction of an air conditioner in accordance with a first embodiment of the present invention.
Figure 2:
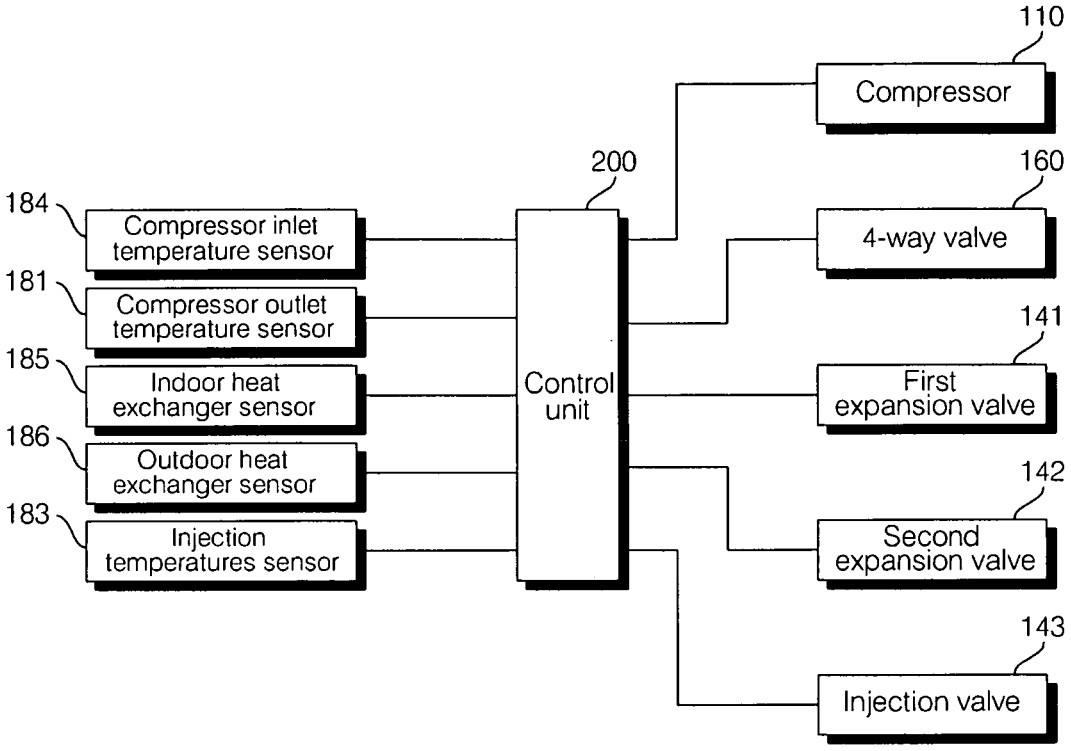
FIG. 2 is a block diagram showing a control flow of the air conditioner.

FIG. 1 is a view showing the construction of an air conditioner 100 in accordance with a first embodiment of the present invention. FIG. 2 is a block diagram showing a control flow of the air conditioner 100.

Referring to FIGS. 1 and 2, the air conditioner 100 includes a compressor 110, an indoor heat exchanger 120, an outdoor heat exchanger 130, a first expansion valve 141, a second expansion valve 142, a phase separator 150, and a 4-way valve 160. The indoor heat exchanger 120 functions as an evaporator in a cooling operation and functions as a condenser in a heating operation. The compressor 110 compresses an introduced refrigerant of low temperature and low pressure into a refrigerant of high temperature and high pressure. The compressor 110 includes a first compressing part 111 and a second compressing part 112. The first compressing part 111 compresses the refrigerant introduced from the evaporator, and the second compressing part 112 mixes and compresses the refrigerant coming from the first compressing part 111 and the refrigerant injected by being branched between the evaporator and the condenser. However, the present invention is not limited thereto, and the compressor 110 can have a multi-layered structure more than three layers.

The 4-way valve 160 is a flow path switching valve for switching the flow of refrigerant upon cooling and heating, and guides the refrigerant compressed in the compressor 110 to the outdoor heat exchanger 130 upon cooling and guides the same to the indoor heat exchanger 120 upon heating. The 4-way valve 160 and the compressor 110 are connected via a first connecting pipe 171. A compressor outlet temperature sensor 181 and a discharge pressure sensor 182 are disposed on the first connecting pipe 171 in order to measure the discharge temperature and pressure of the refrigerant discharged from the compressor 110. The indoor heat exchanger 120 is disposed in a room, and is connected to the 4-way vale 160 via a second connecting pipe 172.

The phase separator 150 separates an introduced refrigerant into a gaseous refrigerant and a liquid refrigerant, sends the liquid refrigerant to the evaporator, and sends the gaseous refrigerant to the second compressing part 112. A first connecting part 151 of the phase separator 150 and the indoor heat exchanger 120 are connected via a third connecting pipe 173. The first connecting part 151 serves as a liquid refrigerant discharge pipe in a cooling operation and serves as a refrigerant inlet pipe in a heating operation.

The first expansion valve 141 is disposed on the third connecting pipe 173, and serves as a second expansion device for throttling the liquid refrigerant introduced from the phase separator 150 in a cooling operation and serves as a first expansion device for throttling the liquid refrigerant introduced from the indoor heat exchanger 120 in a heating operation.

The outdoor heat exchanger 130 is disposed outdoors, and is connected to a second connecting part 152 of the phase separator 150 via a fourth connecting pipe 174. The second connecting pipe 152 serves as a refrigerant inlet pipe in a cooling operation and serves as a liquid refrigerant discharge pipe in a heating operation.

The second expansion valve 142 is disposed on the fourth connecting pipe 174, and serves as a first expansion device for throttling the liquid refrigerant introduced from the heat exchanger 130 in a cooling operation and serves as a second expansion device for throttling the liquid refrigerant introduced from the phase separator 150 in a heating operation.

The outdoor heat exchanger 130 is connected to the four-way valve 160 via a fifth connecting pipe 175. Also, the 4-way valve 160 and an inlet pipe of the compressor 110 are connected via a sixth connecting pipe 176. A compressor inlet temperature sensor 184 for measuring the temperature of the inlet side of the compressor 110 is disposed on the sixth connecting pipe 176.

The second compressing part 112 is connected to a third connecting part 153 of the phase separator 150 via an injection pipe 180. The third connecting pipe 153 is used as a gaseous refrigerant discharge pipe in cooling and heating operations. An injection valve 143 is disposed on the injection pipe 180. The injection valve 143 controls the amount and pressure of the refrigerant injected into the second compressing part 112 from the phase separator 150. When the injection pipe 180 is opened, the gaseous refrigerant in the phase separator 150 is introduced into the second compressing part 112 through the injection pipe 180. An injection temperature sensor 183 for measuring the temperature of the refrigerant being injected is disposed on the injection pipe 180.

The opening degree of the first and second expansion valves 141 and 142 and the injection valve 143 is controlled by a control unit 200 for controlling the operation of the air conditioner.

Figure 3:
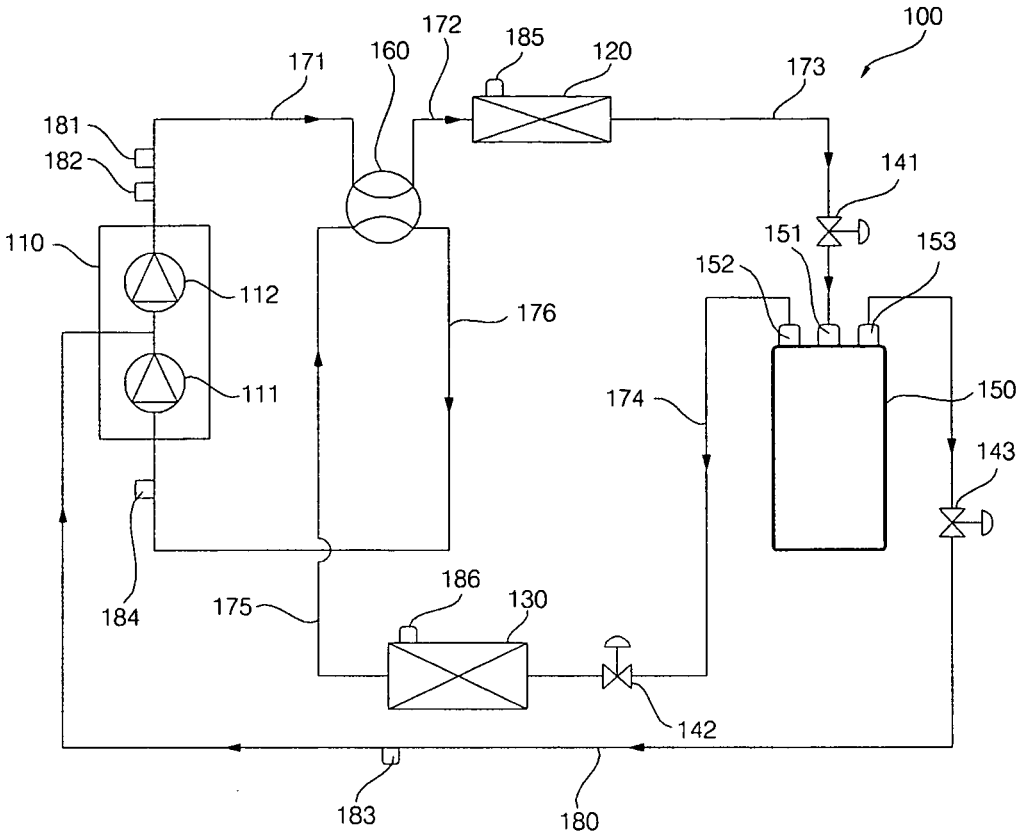
FIG. 3 illustrates the flow of refrigerant in the heating operation of the air conditioner.

FIG. 3 illustrates the flow of refrigerant in the heating operation of the air conditioner.

Referring to FIG. 3, a gaseous refrigerant of high temperature and high pressure discharged from the compressor 110 is introduced into the indoor heat exchanger 120 via the 4-way valve 160. In the indoor heat exchanger 120, the gaseous refrigerant is condensed by heat exchange with indoor air. The condensed refrigerant is throttled in the first expansion valve 141, and then introduced into the phase separator 150. The liquid refrigerant separated by the phase separator 150 is throttled again in the second expansion valve 142, and then introduced into the outdoor heat exchanger 130. The refrigerant in the outdoor heat exchanger 130 is evaporated by heat exchange with ambient air, and the evaporated refrigerant is introduced into the first compressing part 111.

If there is a request for performing gas injection during the heating operation, the control unit 200 opens the injection valve 143. As the injection valve 143 is opened, the gaseous refrigerant separated from the phase separator 150 is injected into the second compressing part 112 through the injection pipe 180. In the second compressing part 112, the injected refrigerant and the refrigerant coming from the first compressing part 111 are mixed and then compressed. The refrigerant compressed in the second compressing part 112 circulates again to the 4-way valve 160.

Figure 4:
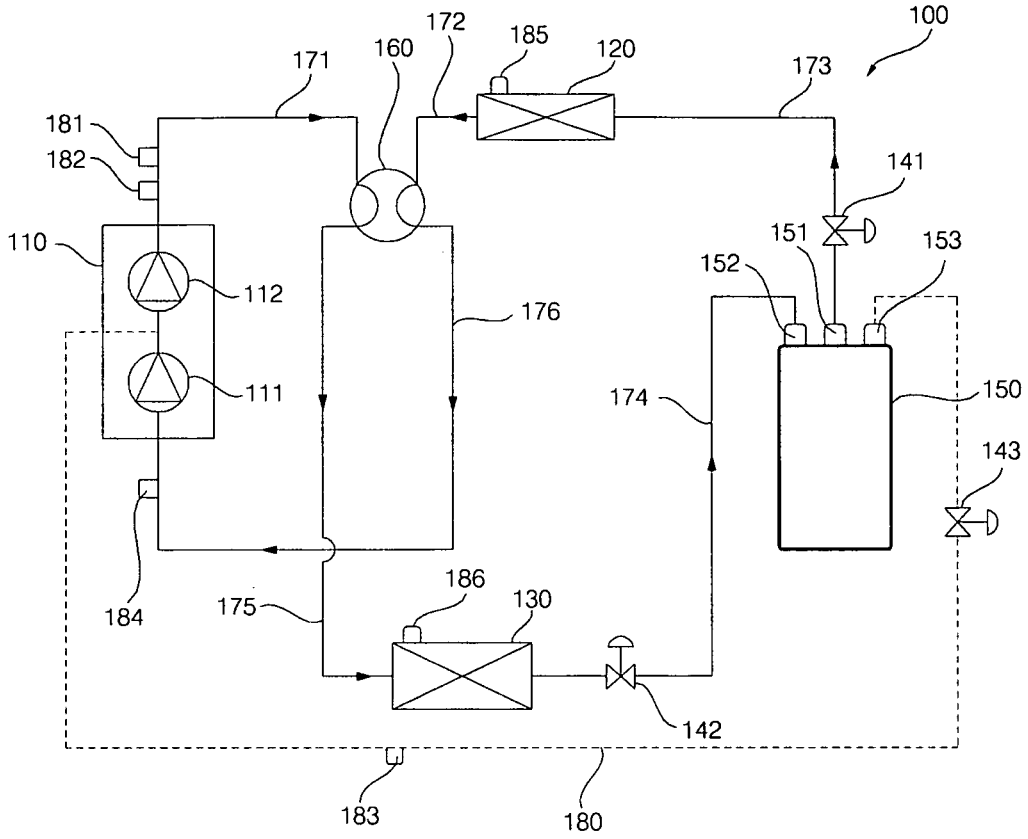
FIG. 4 illustrates the flow of refrigerant in the cooling operation of the air conditioner.

FIG. 4 illustrates the flow of refrigerant in the cooling operation of the air conditioner.

Referring to FIG. 4, a gaseous refrigerant of high temperature and high pressure discharged from the compressor 110 is introduced into the outdoor heat exchanger 130 via the 4-way valve 160. In the outdoor heat exchanger 130, the gaseous refrigerant is condensed by heat exchange with indoor air. The condensed refrigerant is throttled in the second expansion valve 142, and then introduced into the phase separator 150. The liquid refrigerant separated by the phase separator 150 is throttled again in the first expansion valve 141, and then introduced into the indoor heat exchanger 120. The refrigerant in the indoor heat exchanger 120 is evaporated by heat exchange with ambient air, and the evaporated refrigerant is introduced into the first compressing part 111.

If there is no request for performing gas injection during the cooling operation, the control unit 200 closes the injection valve 143, thus keeping the gaseous refrigerant coming from the phase separator 150 from being injected into the second compressing part 112. However, the present invention is not limited thereto, and in the cooling operation, too, the gaseous refrigerant coming from the phase separator 150 may be injected into the second compressing part 112.

Figure 5:
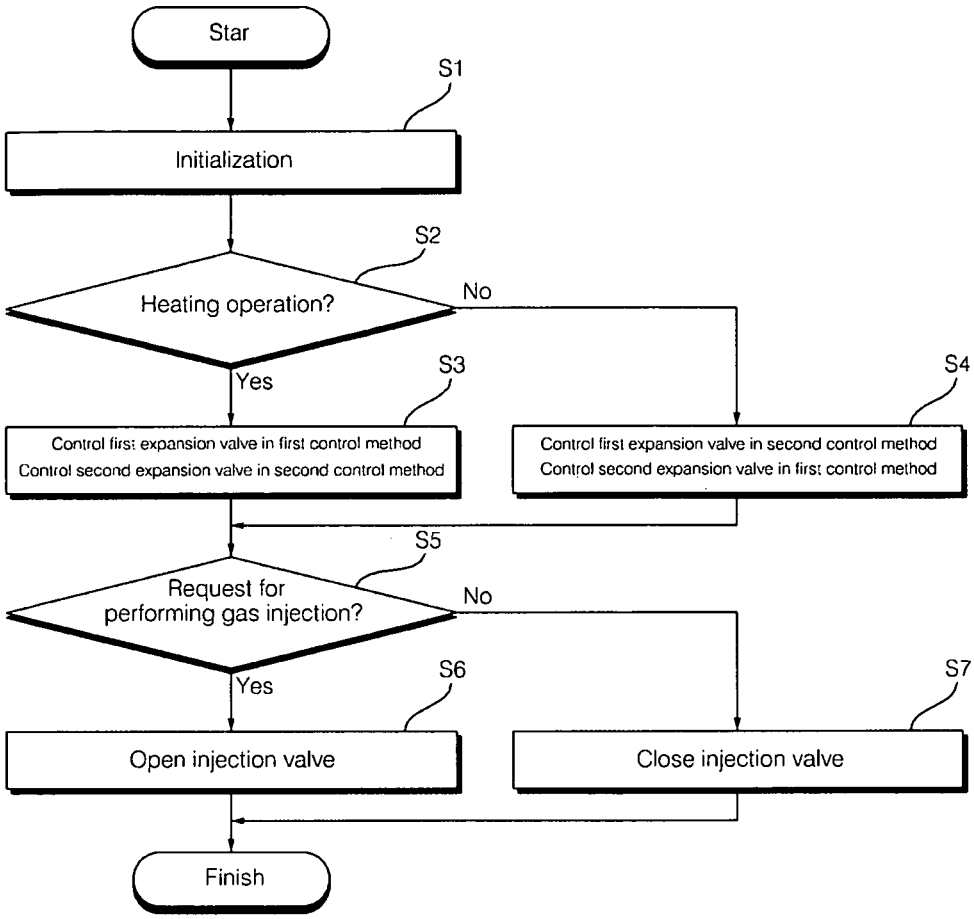
FIG. 5 is a sequential view illustrating a method of controlling first and second expansion valves of an air conditioner as shown in FIG. 1.

FIG. 5 is a sequential view illustrating a method of controlling first and second expansion valves of an air conditioner as shown in FIG. 1.

Referring to FIG. 5, a method of controlling an air conditioner in accordance with the first embodiment of the present invention will be described below.

If a user drives the air conditioner 100 in order to cool and heat an indoor space, the control unit 200 detects a driving command.

When the driving command is detected, the control unit 200 initializes the first and second expansion valves 141 and 142 and the injection valve 143. (S1). That is to say, the control unit 200 fully opens the first and second expansion valves 141 and 142, and closes the injection valve 143. By closing the injection valve 143, a liquid refrigerant can be kept from being introduced into the compressor 110 at an initial stage of driving.

Once the initialization of the first and second expansion valves and the injection valve 143 is finished, the control unit 200 adjusts the degree of superheat so that the refrigerant of the air conditioner 100 may reach a preset target degree of superheat. Further, the refrigerant is adapted to reach a preset intermediate pressure.

Here, the degree of superheat is the difference between the temperature of the refrigerant sucked into the compressor 110 and the saturation temperature with respect to the evaporating pressure of the evaporator. The degree of superheat can be measured by a sensor installed in the evaporator and a compressor inlet temperature sensor 184 installed at the inlet side of the compressor. As the sensor installed in the evaporator, an outdoor heat exchanger sensor 186 installed in the outdoor heat exchanger 130 is used upon heating, and an indoor heat exchanger sensor 185 installed in the indoor heat exchanger 120 is used upon heating.

The intermediate pressure is a pressure in the phase separator 150. By adapting the intermediate pressure to reach a preset intermediate pressure, the work required by the compressor 110 can be reduced, thus increasing efficiency. By adjusting the amount of the refrigerant supplied to the phase separator 150 from the condenser, the intermediate pressure can be adjusted. The intermediate pressure can be calculated from the temperature measured by the injection temperature sensor 183 installed in the injection pipe 180.

The control unit 200 adjusts the opening degree of the valve disposed between the phase separator 150 and the evaporator in order to adjust the degree of superheat. Also, the control unit 200 adjusts the opening degree of the valve disposed between the condenser and the phase separator 150 in order to adjust the intermediate pressure.

The control unit 200 controls the valve for adjusting the intermediate pressure of the refrigerant and the valve for adjusting the degree of superheat of the refrigerant in different control methods. In other words, the control unit 200 controls the opening degree of the valve in a first control method in order to adjust the intermediate pressure, and controls the opening degree of the valve in a second control method different from the first control method in order to adjust the degree of superheat or the like of the refrigerant.

Referring to FIG. 5, the control unit 200 checks whether the air conditioner 100 is in a heating operation mode or in a cooling operation mode, and selects the method of controlling the first expansion valve 141 and the second expansion valve 142 between the first and second methods. (S2)

First, the method of controlling the first and second expansion valves 141 and 142 when the air conditioner 100 is in the heating operation mode will be described below.

If the air conditioner 100 is in the heating operation mode, the control unit 200 controls the first expansion valve 141 in the first control method, and controls the second expansion valve 142 in the second control method. (S3)

If the air conditioner 100 is in the heating operation mode, the first expansion valve 141 throttles the refrigerant introduced into the phase separator 150 after condensed in the indoor heat exchanger 120. At this time, it is possible to make the pressure in the phase separator 150 reach a preset intermediate pressure by adjusting the opening degree of the first expansion valve 141. Therefore, the control unit 200 controls the first expansion valve 141 in the first control method.

Further, the second expansion valve 142 throttles the refrigerant coming from the phase separator 150 and introduced into the outdoor heat exchanger 130. The degree of superheat of the refrigerant can be adjusted by adjusting the opening degree of the second expansion valve 142. Therefore, the control unit 200 controls the second expansion valve 142 in the second control method.

Figure 6:
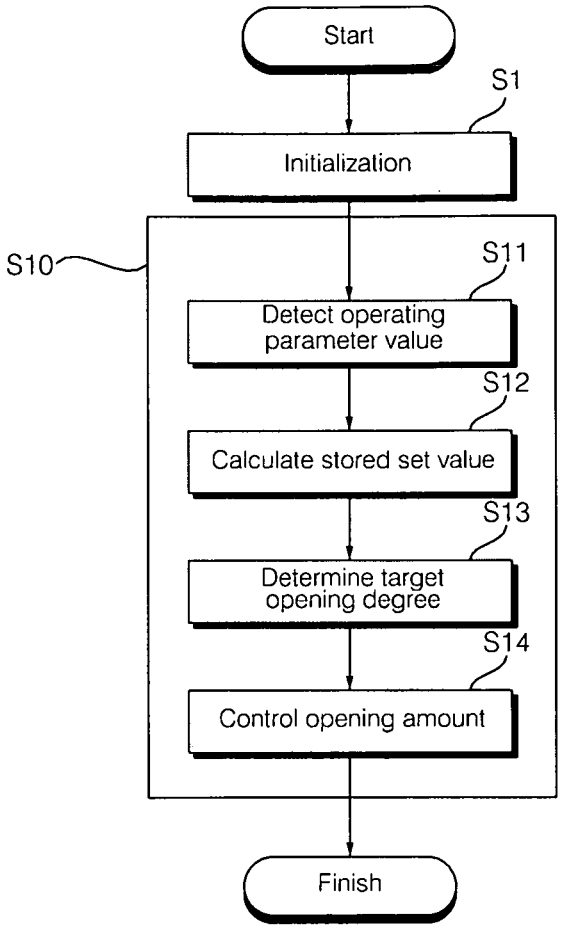
FIG. 6 is a sequential view illustrating a control method for the first expansion valve when the air conditioner in accordance with the first embodiment of the present invention is in a heating operation mode.

FIG. 6 is a sequential view illustrating a first control method for the first expansion valve when the air conditioner as shown in FIG. 1 is in a heating operation mode.

Referring to FIG. 6, in the first control method (S10), when the initialization of the first expansion valve 141 is finished (S1), a value of at least one operating parameter is detected (S11), and a stored set value corresponding to the detected value of the operating parameter is calculated (S12). A target opening degree of the valve is determined based on the set value (S13). The target opening degree of the first expansion valve 141 is determined based on the set value. The operating parameters may include the operability of gas injection in which refrigerant is injected into the second compressing part 112, the frequency of the compressor 110, the indoor temperature of the air conditioner 100, an outdoor temperature, the difference between the indoor and outdoor temperatures, the discharge pressure of the compressor 110, the discharge temperature of the compressor 110, etc. The set values for the operating parameters are preset and stored in a table format in the control unit 200. The set value for the frequency of the compressor 110 may be set differently according to the operability of gas injection.

The set values for the operating parameters change the target opening degree independently. A subsequent method of obtaining the target opening degree is as follows:

Target opening degree=F (A1, A2, A3, A4, A5, . . . )

wherein A1~A5 are the operating parameter values. F (A1, A2, A3, A4, A5, . . . ) can be expressed by the following equation.

In one example, the target opening degree can be obtained by multiplying the set values corresponding to the operating parameters values by each other, and the following equation can be used:

$$F(A1,A2,A3,A4,A5,\ldots)=C*f(A1)*(A2)*(A3)*(A4)*f(A5)*$$

wherein C is a proportional constant, and f(A1), f(A2), . . . are set values for A1, A2, . . . .

Since the operating parameters change the target opening degree of the first expansion valve 141 independently, it is easy to obtain a set value for each operating parameter and it is easy to control.

As above, once the opening degree of the first expansion valve 141 is determined, the control unit 200 increases or decreases the opening degree until the opening degree of the first expansion valve 141 reaches the target opening degree. (S14)

Accordingly, the intermediate pressure of the refrigerant can reach a preset intermediate pressure more rapidly.

Meanwhile, the second control method is a method of measuring the degree of superheat of the refrigerant until the degree of superheat of the refrigerant reaches a target degree of superheat and controlling the opening degree of the valve based on the measured degree of superheat. The degree of superheat of the refrigerant can be measured by the outdoor heat exchanger sensor 186 installed in the outdoor heat exchanger 130 serving as an evaporator in a heating operation and the compressor indoor temperature sensor 184. A fuzzy table is stored in the control unit 200 on the basis of a difference between a measured degree of superheat and a preset target degree of superheat and a change in difference, and the opening degree of the second expansion valve 142 is determined from the fuzzy table.

As above, the opening degree of the second expansion valve 142 continually changes on the basis of the degree of superheat that is measured in real time, and thus the degree of superheat of the refrigerant can be adjusted more precisely according to the operation state of the air conditioner 100.

On the other hand, a method of controlling the first and second expansion valves 141 and 142 when the air conditioner 100 is in a cooling operation mode will be described below.

If the air conditioner 100 is in the cooling operation mode, the control unit 200 controls the first expansion valve 141 in the second control method for adjusting the degree of superheat, and controls the second expansion valve 142 in the first control method for adjusting the intermediate pressure (S4).

If the air conditioner 100 is in the cooling operation mode, the first expansion valve 141 throttles the refrigerant coming from the phase separator 150 and introduced into the indoor heat exchanger 120. Thus, the degree of superheat of the refrigerant can be adjusted by adjusting the opening degree of the first expansion valve 141. Therefore, the control unit 200 controls the first expansion valve 141 in the second control method.

As the first expansion valve 141 is controlled in the second control method, the opening a degree of the first expansion valve 141 continually changes on the basis of the degree of superheat that is measured in real time. Therefore, the degree of superheat of the refrigerant can be adjusted more precisely.

Further, the second expansion valve 142 throttles the refrigerant introduced into the phase separator 150 after condensed in the outdoor heat exchanger 130. Thus, it is possible to make the pressure in the phase separator 150 reach a preset intermediate pressure by adjusting the opening amount of the second expansion valve 142. Therefore, the control unit 200 controls the second expansion valve 142 in the first control method S10.

As the second expansion valve 142 is controlled in the first control method S10, the target opening degree of the second expansion valve 142 is set on the basis of a stored set value corresponding to the detected value of the operating parameter. The opening amount of the second expansion valve 142 decreases or increases at a time until the opening degree of the second expansion valve 142 reaches the target opening degree. Therefore, the intermediate pressure of the refrigerant can be adjusted more rapidly.

In the present invention, the first expansion valve 141 is controlled in the first control method S10 if the air conditioner 100 is in the heating operation mode, while the first expansion valve 141 is controlled in the second control method if the air conditioner 100 is in the cooling operation mode. In contrast, the second expansion valve 141 is controlled in the second control method if the air conditioner 100 is in the heating operation mode, while the second expansion valve 142 is controlled in the first control method S10 if the air conditioner 100 is in the heating operation mode. Hence, the roles of the first and second expansion valves 141 and 142 become different depending on the cooling and heating operation modes of the air conditioner 100 and, accordingly, the control method becomes different, thereby improving the performance and stability of the system.

Meanwhile, it is checked whether there is a request for performing gas injection regardless of the cooling and heating operation modes (S5).

If there is a request for performing gas injection, the control unit 200 opens the injection valve 143. On the other hand, if there is no request for performing gas injection, the control unit 200 closes the injection valve 143 (S7).

Alternatively, in a second embodiment, which is different from the first embodiment, the target opening degree can be obtained by the following equation. The following description focuses on these differences with the foregoing embodiment.

Target opening degree=F (A1, A2, A3, A4, A5, . . . )

wherein A1~A5 are the operating parameter values. F (A1, A2, A3, A4, A5, . . . ) can be expressed by the following equation:

$$F(A1,A2,A3,A4,A5,\ldots)=C*f(A1-A1_s)+C2*(A2-A2_s)+C3*(A3-A3_s)+$$

wherein C1, C2, . . . are proportional constants, and A1_*s*, A2_*s*, . . . are reference values for A1, A2, . . . C1*(A1–A1_*s*) is a set value for A1.

In other words, the target opening degree can be obtained by adding the set values to each other. In the above equation, the target opening degree is obtained by linearly combining the set values, thus making easier the control of the first expansion device over each of the set values.

Alternatively, in a third embodiment, which is different from the previous embodiments, the target opening degree can be obtained by the following equation. Hereinafter, description will be made with respect to the differences with the foregoing embodiment.

Target opening degree=F (A1, A2, A3, A4, A5, . . . )

wherein A1~A5 are the operating parameter values. F (A1, A2, A3, A4, A5, . . . ) can be expressed by the following equation:

$$F(A1,A2,A3,A4,A5,\ldots)=c1*f1(A1)+c2*f2(A2)+c3*f3(A3)+$$

wherein C1, C2, . . . are proportional constants.

In the above equation, the actual characteristics of the operating parameter values can be expressed by using various constants (f1, f2, f3 . . . ), thus improving the accuracy of control.

Hereinafter, a control method for first and second expansion valves of an air conditioner in accordance with a fourth embodiment of the present invention will be described. The following description focuses on the difference with the first embodiment. The same reference numerals as those in the first embodiment denote the same members.

The difference with the first embodiment is that the control unit 200 controls the first expansion device in a different control method according to the operation state of the air conditioner. That is to say, the control unit 200 selects any one of the first control method S20 and a safety control method S30, and controls the first expansion device.

If the air conditioner is in a heating operation, the first expansion valve 141 serves as the first expansion device for adjusting the intermediate pressure and the second expansion valve 142 serves as the second expansion device for adjusting the degree of superheat.

Figure 7:
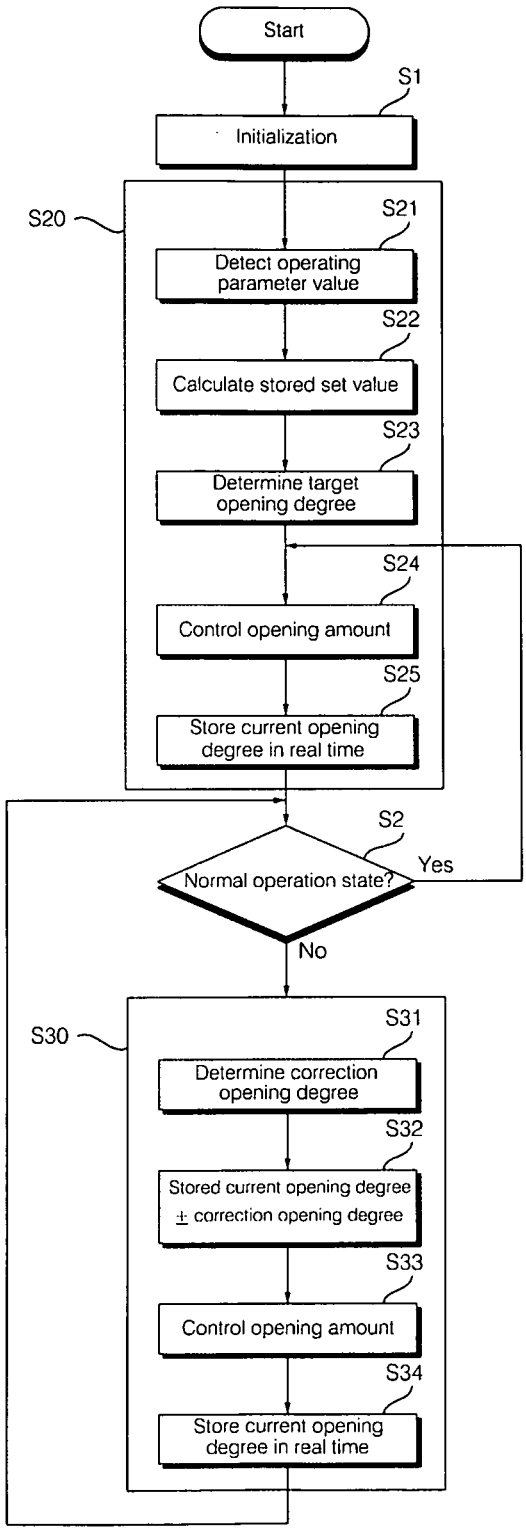
FIG. 7 is a sequential view illustrating a control method for a first expansion valve when an air conditioner according to a fourth embodiment of the present invention is in a heating operation mode.

FIG. 7 is a sequential view illustrating a control method for a first expansion valve when an air conditioner according to a fourth embodiment of the present invention is in a heating operation mode.

Referring to FIG. 7, when the initialization of the first expansion valve 141 is finished (S1), the control unit 200 adjusts the opening amount of the first expansion valve 141 in order to adjust the intermediate pressure. At this time, the control unit 200 selects any one of the first control method S20 and the safety control method S30 according to the operation state of the air conditioner 100, and controls the first expansion valve 141. That is, the control unit 200 judges whether the air conditioner 100 is in a normal operation state, and switches the control method for the first expansion valve 141 according to the result. If the operating parameter value is within a preset normal operating range, the control unit 200 judges the air conditioner to be in the normal operation state, and controls the first expansion valve 141 in the first control method S20. Otherwise, if the operating parameter value is out of the preset normal operating range, the control method for the first expansion valve 141 is switched to the safety control method S30 which is different from the first control method S20.

The control unit 200 detects the operating parameters, such as the discharge temperature of the refrigerant discharged from the compressor 110 and the temperature of the refrigerant passed through the indoor heat exchangers 120 serving as a condenser in a heating operation. If the detected values of the operating parameters are out of a preset normal range, the control unit 200 judges that there may be problems like liquid compression, and thus the control unit 200 switches to the safety control method S30 which is capable of preventing liquid compression or the like.

First, if the operating parameter values are within the preset normal operating range, the air conditioner 100 is judged to be in a normal operation state and the first control method S20 is performed.

In the first control method S20, a value of the operating parameter is detected (S21), and a stored set value corresponding to the detected value of the operating parameter is calculated (S22). Based on the set value, a target opening degree of the first expansion valve is determined (S23). Once the target opening degree is determined, the opening amount is increased or decreased at a time so that the opening degree of the first expansion valve 141 may reach the target opening degree (S24). Therefore, the intermediate pressure of the refrigerant can reach a preset intermediate pressure more rapidly.

The control unit 200 stores the current opening degree of the first expansion valve 141 during the execution of the first control method S20 (S25). The current opening degree stored in the first control method S20 is used upon switching from the first control method S20 to the safety control method S30.

During the execution of the first control method S20, the control unit 200 detects whether the operating parameters, such as the discharge temperature of the refrigerant discharged from the compressor 110 and the temperature of the refrigerant passed through the indoor heat exchangers 120, are out of a preset normal operating range (S26). If the operating parameters, such as the discharge temperature of the refrigerant discharged from the compressor 110 and the temperature of the refrigerant passed through the indoor heat exchangers 120, are out of a preset normal operating range, the control unit 200 switches from the first control method S20 to the safety control method S30.

The control unit 200 measures a refrigerant discharge temperature of the compressor 110 in order to get the discharge temperature of the refrigerant discharged from the compressor 110 and prevent liquid compression. If the measured refrigerant discharge temperature is out of a preset normal operating range and lower than a preset temperature, the control unit 200 switches from the first control method S20 to the safety control method S30. The normal operating range is preset and stored in the control unit 200 according to the operating condition or the like of the air conditioner.

When the first control method S20 is switched to the safety control method S30, the current opening degree stored during the execution of the first control method S20 is combined with a correction opening degree in the safety control method S30 (S32). The correction opening degree may be determined based on the refrigerant discharge temperature (S31). The opening amount of the first expansion valve 141 is controlled according to the combined value of the current opening degree and the correction opening degree (S33). That is to say, the opening amount of the first expansion valve 141 can be increased by adding the correction opening degree to the current opening degree, or the opening amount of the first expansion valve 141 can be decreased by subtracting the correction opening degree from the current opening degree.

During the execution of the safety control method S30, the current opening degree of the first expansion valve 141 is stored in real time (S34). Therefore, during the execution of the safety control method S30, the current opening degree stored during the execution of the safety control method S30 is combined with the correction opening degree.

The safety control method S30 is a method of opening or closing as much as the correction opening degree from the current opening degree stored. That is, the opening degree of the first expansion valve 141 is gradually reduced by the correction opening degree until the refrigerant discharge temperature of the compressor 110 is higher than a preset temperature. As the opening degree of the first expansion valve 141 is reduced, the amount of the refrigerant is reduced, thus making it possible to ensure the refrigerant discharge temperature of the compressor 110. Accordingly, liquid compression in the compressor 110 can be prevented.

Meanwhile, if the refrigerant discharge temperature of the compressor 110 returns to the normal operating range during the execution of the safety control method S30, the control unit 200 switches from the safety control method S30 to the first control method S20 to control the opening amount of the first expansion valve 141.

If the refrigerant discharge temperature of the compressor 110 is within a preset normal operating range, the control unit 200 measures the temperature of the refrigerant coming from the indoor heat exchanger 120. If the temperature of the refrigerant passed through the indoor heat exchanger 120 is out of the preset normal operating range and lower than a preset temperature, the control unit 200 switches from the first control method S20 to the safety control method S30. Upon switching from the first control method S20 to the safety control method S30, in the safety control method S30, a correction opening degree is determined based on the temperature of the refrigerant passed through the indoor heat exchanger 120, and the correction opening degree is combined with the current opening degree. Then, the opening amount of the first expansion valve 141 is controlled according to the combined value thereof. Afterwards, the current opening degree of the first expansion valve 141 is stored in real time during the execution of the safety control method S30, and the correction opening degree is combined with the current opening degree stored during the execution of the safety control method S30. The opening degree of the first expansion valve 141 is gradually increased by the correction opening degree until the temperature of the refrigerant passed through the indoor heat exchanger 120 is higher than a preset temperature. By increasing the opening degree of the first expansion valve 141, the temperature of the outlet side of the indoor heat exchanger 120 can be increased.

If the temperature of the refrigerant passed through the indoor heat exchanger returns to a temperature higher than the preset temperature, the control unit 200 switches from the safety control method S30 to the first control method S20 to control the opening amount of the first expansion valve 141.

Further, if the temperature of the refrigerant passed through the indoor heat exchanger 120 is within a preset normal operating range, the discharge temperature of the compressor 110 is measured in order to prevent the discharge temperature of the compressor 110 from being excessively increased. If the discharge temperature of the compressor 110 is out of the normal operating range and exceeds a preset temperature, the control unit 200 switches from the first control method S20 to the safety control method S30. In the safety control method S30, the correction opening degree is combined with the opening degree of the first expansion valve 141 stored during the execution of the first control method S20 to control the opening amount of the first expansion valve 141. Afterwards, the current opening degree of the first expansion valve 141 is stored in real time during the execution of the safety control method S30, and the correction opening degree is combined with the opening degree stored during the execution of the safety control method S30. The opening degree of the first expansion valve 141 is gradually increased by the correction opening degree until the discharge temperature of the compressor 110 is lower than a preset temperature. By increasing the opening degree of the first expansion valve 141, the discharge temperature of the compressor 110 can be prevented from being increased. Accordingly, damage of the compressor 110 can be prevented.

If the refrigerant discharge temperature of the compressor 110 is dropped to lower than a preset temperature, the control unit 200 switches from the safety control method S30 to the first control method S20 to control the opening amount of the first expansion valve 141.

In the first control method S20, a target opening degree is set regardless of the current opening degree of the first expansion valve 141, and the target opening degree is reached at a time. Therefore, if the air conditioner is in a normal operation state, more rapid control can be performed compared to the controlling of the first expansion valve 141 in the first control method S20.

On the other hand, in the safety control method S30, the opening degree of the first expansion valve 141 is gradually decreased or gradually increased. Therefore, if the air conditioner 100 is not in a normal operation state, the opening amount of the first expansion valve 141 is controlled more precisely according to the operation state, thereby making it easier to return to the normal operation state.

Meanwhile, the control unit 200 controls the opening amount of the second expansion valve 142 so that the degree of superheat can reach a preset target degree of superheat. The control unit 200 is able to control the opening amount of the second expansion valve 142 by correcting the target degree of superheat in order to ensure the discharge temperature of the compressor 110 after the initialization of the second expansion valve 142. That is to say, after the initialization of the second expansion valve 142, if the discharge temperature of the compressor 110 is lower than a preset temperature, the control unit 200 can set a new target degree of superheat by correcting the preset target degree of superheat by a predetermined value, and accordingly can control the opening amount of the second expansion valve 142. Therefore, after the initialization of the second expansion valve 142, the discharge temperature of the compressor 110 can be ensured.

Afterwards, if the discharge temperature of the compressor 10 is higher than a preset temperature, the control unit 200 can control the opening amount of the second expansion valve 142 so as to reach a preset target degree of superheat.

Meanwhile, in a cooling operation, the second expansion valve 142 serves as the first expansion device for adjusting the intermediate pressure and the first expansion valve 142 serves as the second expansion device for adjusting the degree of superheat.

Accordingly, in the cooing operation, one of the first control method S20 and the safety control method S30 is selected to control the second expansion valve 142 according to the operation state. That is, if an operating parameter value is within a normal operating range, the second expansion valve 142 is controlled in the first control method S20, while, if the operating parameter value is out of the normal operating range, the first control method S20 is switched to the safety control method S30 to control the opening amount of the second expansion valve 142.

In other words, if the refrigerant discharge temperature of the compressor 110 is out of the normal operating range and is lower than a preset temperature, the first control method S20 is switched to the safety control method S30. In the safety control method S30, a correction opening degree is determined according to the refrigerant discharge temperature. And, the opening degree of the second expansion valve 142 is gradually reduced by the correction opening degree until the refrigerant discharge temperature is higher than the preset temperature. As the second expansion valve 142 is gradually closed, the refrigerant discharge temperature of the compressor 110 cab be ensured.

Further, the temperature of the inlet side of the indoor heat exchanger 120 serving as the evaporator is out of the normal operating range and is lower than a preset temperature, the first control method S20 is switched to the safety control method S30. In the safety control method S30, a correction opening degree is determined according to the temperature of the inlet side of the indoor heat exchanger S30. And, the opening degree of the second expansion valve 142 is gradually increased by the correction opening degree until the temperature of the inlet side of the indoor heat exchanger 120 is within the normal operating range. Therefore, pipelines at the inlet side of the indoor heat exchanger 120 can be prevented from freezing.

Further, if the discharge temperature of the compressor 110 is out of the normal operating range and exceeds a preset temperature, the first control method S20 is switched to the safety control method S30. In the safety control method S30, a correction opening degree is determined according to the discharge temperature of the compressor 110. And, the opening degree of the second expansion valve 142 is gradually increased by the correction opening degree until the discharge temperature of the compressor 110 is lower than the preset temperature. Therefore, the discharge temperature of the compressor 110 can be prevented from being excessively increased.

Also, when the air conditioner 100 is in overload, a preset target degree of superheat is corrected by a predetermined value to set a new target degree of superheat, and accordingly the opening amount of the first expansion valve 141 can be controlled. Therefore, it is possible to cope with the overload of the air conditioner 100.

Hereinafter, a control method for first and second expansion valves of an air conditioner in accordance with a fifth embodiment of the present invention will be described. The following description focuses on the difference with the first embodiment. The same reference numerals as those in the first embodiment denote the same members.

The difference with the first embodiment is that the control unit 200 uses a plurality of different control methods in order to adjust the intermediate pressure. That is to say, the control unit 200 determines a control method for the first expansion device for adjusting the intermediate pressure by comparing the degree of superheat of the refrigerant with a preset range of a target degree of superheat. The range of the target degree of superheat is a range of a target degree of superheat, which can be preset by an experiment or the like, and in which the cycle of the air conditioner can be stabilized. The control unit 200 determines a control method by comparing the degree of superheat of the refrigerant with the range of the target degree of superheat and accordingly judging whether the cycle is stabilized or not. In other words, if the degree of superheat of the refrigerant is out of the range of target degree of superheat, the first expansion device is controlled in the first control method S10, and if the degree of superheat of the refrigerant is within a preset range of a target degree of superheat, the first expansion device is controlled in a fuzzy control method S40 which is switched from the first control method S10.

First, if the air conditioner is in a heating operation, the first expansion valve 141 serves as the first expansion device for adjusting the intermediate pressure, and the second expansion valve 142 serves as the second expansion device for adjusting the degree of superheat.

Figure 8:
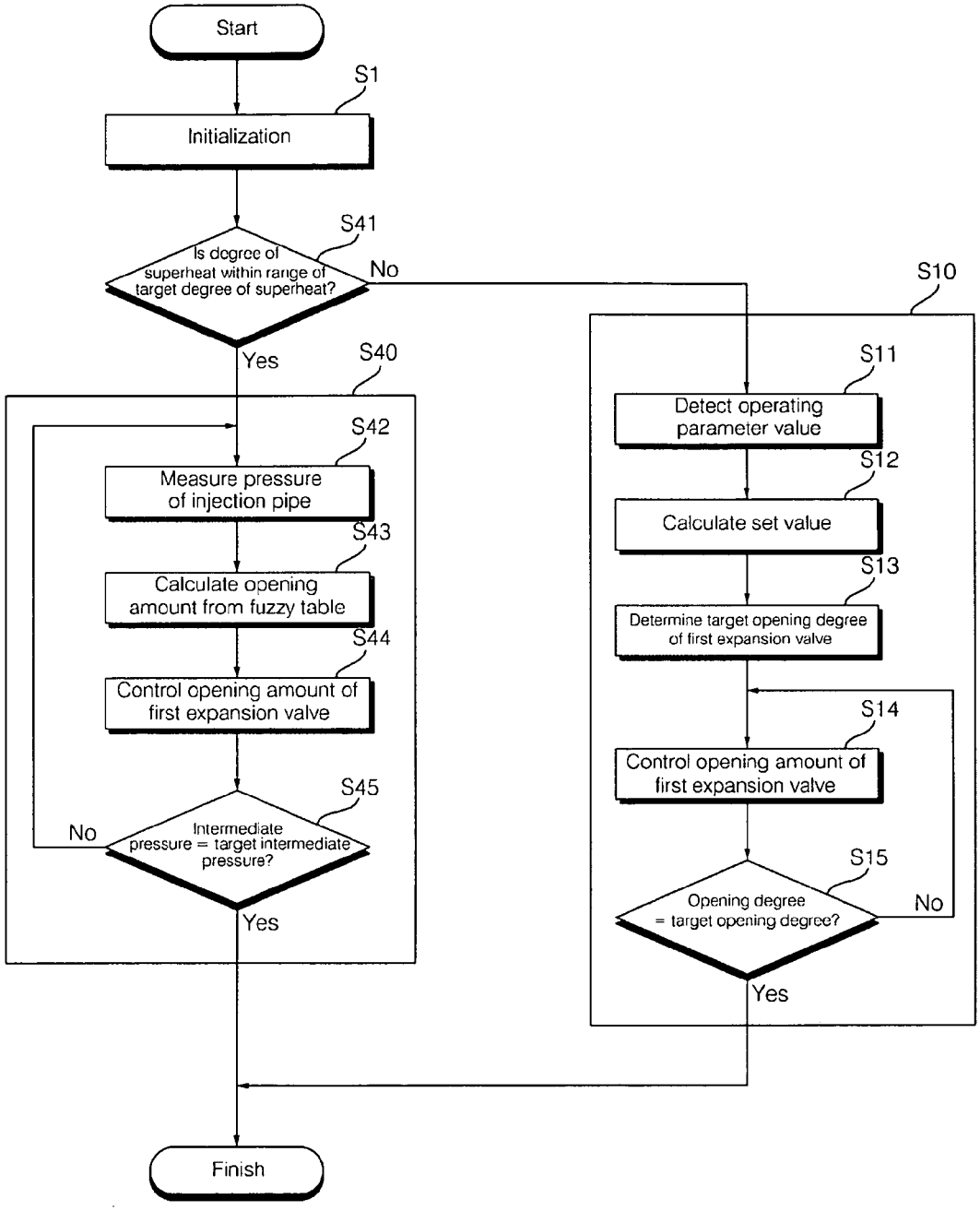
FIG. 8 is a sequential view illustrating a control method for a first expansion valve when an air conditioner in accordance with a fifth embodiment of the present invention is in a heating operation mode.

FIG. 8 is a sequential view illustrating a control method for a first expansion valve when an air conditioner in accordance with a fifth embodiment of the present invention is in a heating operation mode.

Referring to FIG. 8, the control unit 200 initializes the first expansion valve 141, and then adjusts the opening amount of the first expansion valve 141 in order to adjust the intermediate pressure. At this time, the control unit 200 selects any one of the first control method S10 and the fuzzy control method S40 according to the degree of superheat of the refrigerant to control the first expansion valve 141.

It is checked whether the degree of superheat of the refrigerant is out of the range of the target degree of superheat or not (S410). If the degree of superheat of the refrigerant is out of the range of the target degree of superheat, the control unit 200 controls the first expansion valve 141 in a first control method S10. In the first control method S10, a value of the operating parameter is detected (S11), and a stored set value corresponding to the detected value of the operating parameter is calculated (S12). Based on the set value, a target opening degree of the first expansion valve is determined (S13). Once the target opening degree is determined, the opening amount is increased or decreased at a time so that the opening degree of the first expansion valve 141 may reach the target opening degree (S14, S15). Therefore, the intermediate pressure of the refrigerant can reach a preset intermediate pressure more rapidly. Details of the first control method S10 are the same as those in the first embodiment, so they will be omitted.

Meanwhile, if the degree of superheat of the refrigerant is within a preset range of a target degree of superheat, the control unit 200 judges that the cycle of the air conditioner enters a stabilization step. Accordingly, the control unit 200 controls the first expansion valve 141 in the fuzzy control method S40 in order to match the intermediate of the refrigerant with a preset intermediate pressure more precisely.

In the control unit 200, a fuzzy table is stored according to an operating parameter value. In the fuzzy control method S40, an operating parameter value is measured, and the opening amount of the first expansion valve 141 is fuzzy-controlled according to the fuzzy table. Here, the operating parameter value will be explained by way of example of the pressure of the injection pipe 180. The opening amount of the first expansion valve 141 is continually changed until the pressure of the injection pipe 180 reaches a preset intermediate pressure. The pressure of the injection pipe 180 can be ensured by measuring a temperature from the injection temperature sensor 183 installed in the injection pipe 180 and converting the measured injection temperature into a pressure (S42). A fuzzy table is stored in the control unit 200 based on the injection temperature. On the basis of the fuzzy table, the control unit 200 calculates the opening amount of the first expansion valve 141 (S43), and changes the opening amount of the first expansion valve 141 (S44). Afterwards, the opening amount of the first expansion valve 141 is feedback-controlled until the injection pressure reaches the target intermediate pressure (S45).

Accordingly, the first control method S10 is a method in which the target opening degree of the first expansion valve 141 is determined and the opening amount of the first expansion valve 141 is opened or increased at a time until the current opening degree of the first expansion valve 141 reaches the target opening degree. The fuzzy control method S40 is a method of gradually changing the opening amount of the first expansion valve 141 according to the injection temperature or pressure. That is, in the fuzzy control method 40, the opening amount of the first expansion valve 141 is finely adjusted compared to the first control method S10.

Accordingly, if the degree of superheat of the refrigerant is out of the range of the target degree of superheat, the opening amount of the first expansion valve 141 can be adjusted to a greater extent by using the first control method S10. If the degree of superheat of the refrigerant is within the range of the target degree of superheat, the opening amount of the first expansion valve 141 is finely adjusted by using the fuzzy control method S40, thereby matching the intermediate pressure of the refrigerant with a preset intermediate pressure more precisely.

Meanwhile, if the air conditioner is in a cooling operation mode, the second expansion valve 142 serves as the first expansion device for adjusting the intermediate pressure, and the first expansion valve 141 serves as the second expansion device for adjusting the degree of superheat.

Accordingly, in the cooing operation, one of the first control method S10 and the fuzzy control method S40 is selected to control the second expansion valve 142 according to the operation state. That is, if the degree of superheat of the refrigerant is out of the range of the target degree of superheat, the second expansion valve 142 is controlled in the first control method S10, while, if the degree of superheat of the refrigerant is within the range of the target degree of superheat, the second expansion valve 142 is controlled in the fuzzy control method S40.

Hereinafter, a control method for first and second expansion valves of an air conditioner in accordance with a sixth embodiment of the present invention will be described. The following description focuses on the difference with the first embodiment. The same reference numerals as those in the first embodiment denote the same members.

The difference with the first embodiment is that, in a first control method S50 for controlling the first expansion device for adjusting the intermediate pressure, the control unit 200 controls such that a target opening degree of the first expansion device may be determined and then a change in opening degree may change according to the opening time of the first expansion device until the opening degree of the first expansion device reaches the target opening degree.

First, if the air conditioner is in a heating operation, the first expansion valve 141 serves as the first expansion device for adjusting the intermediate pressure, and the second expansion valve 142 serves as the second expansion device for adjusting the degree of superheat.

Figure 9:
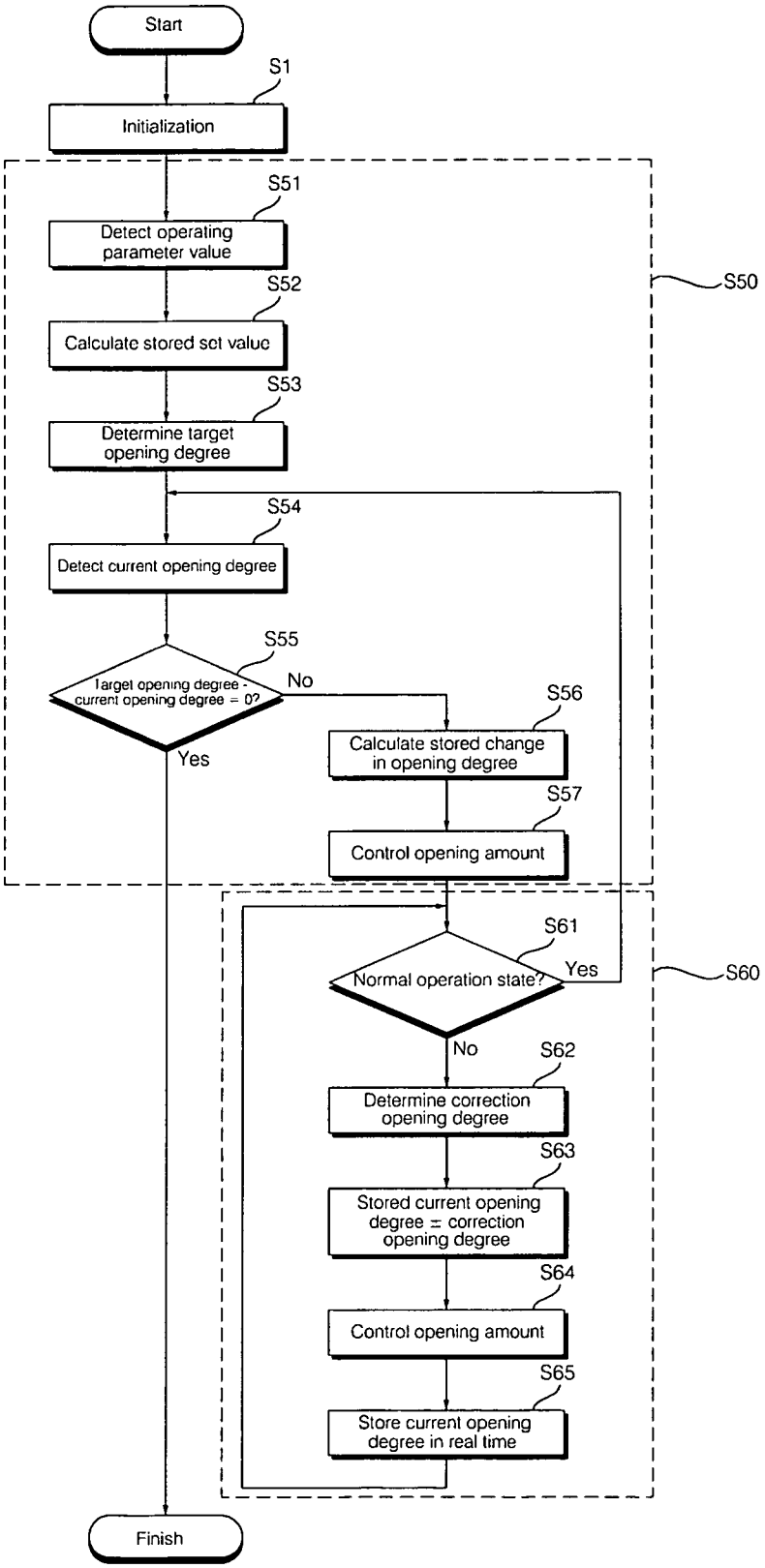
FIG. 9 is a sequential view illustrating a control method for a first expansion valve when an air conditioner in accordance with a sixth embodiment of the present invention is in a heating operation mode.

FIG. 9 is a sequential view illustrating a control method for a first expansion valve when an air conditioner in accordance with a sixth embodiment of the present invention is in a heating operation mode.

Referring to FIG. 9, the control unit 200 controls the opening amount of the first expansion valve 141 in a first control method S50 in order to adjust the intermediate pressure after finishing the initialization of the first expansion valve 141. In the first control method S50, it is controlled such that a target opening degree of the first expansion valve 141 is determined, and then a change in opening degree changes according to the opening time of the first expansion valve 141 until the opening degree of the first expansion valve 141 reaches the target opening degree.

In the first control method S50, a value of at least one operating parameter is detected (S51). The control unit 200 can obtain set values for the operating parameter value from the table (S52). A target opening degree of the first expansion valve is determined based on the set values (S53). The target opening degree can be obtained by a combination of the set values.

Next, the control unit 200 detects and stores the current opening degree of the first expansion vale 141 in real time (S54). The stored current opening degree and the target opening degree are compared with each other (S55). If the current opening degree and the target opening degree are different from each other, a change in opening degree is determined depending on the difference between the current opening degree and the target opening degree. The change in opening degree is preset depending on the difference between the current opening degree and the target opening degree. The change in opening degree is stored in a table format in the control unit 200. Therefore, the control unit 200 obtains the difference between the current opening degree and the target opening degree, and obtains the change in opening degree from the table (S56).

Once the change in opening degree is determined, the opening degree of the first expansion valve 141 is changed by the change in opening degree (S57).

The control unit 200 continually detects the current opening degree of the first expansion valve 141 (S54). Then, the current opening degree of the first expansion valve 141 and the target opening degree are compared with each other again (S55). If the current opening degree and the target opening degree are different, the difference is calculated, and a change in opening degree is determined again depending on the difference (S56). If the change in opening degree is determined again, the opening degree of the first expansion valve is changed by the change in opening degree that has been determined again (S57).

The above-described process is repeated until the current opening degree of the first expansion valve is consistent with the target opening degree or within an error range.

Figure 10:
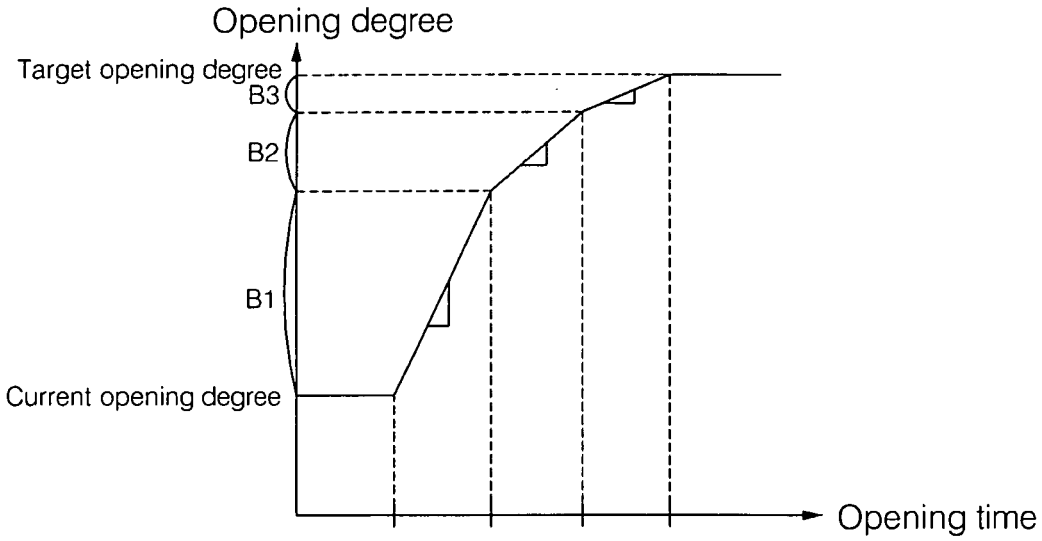
FIG. 10 is a graph showing a change in opening degree according to the opening time of the first expansion valve in accordance with the sixth embodiment of the present invention.

FIG. 10 is a graph showing a change in opening degree according to the opening time of the first expansion valve in accordance with the sixth embodiment of the present invention.

Referring to FIG. 10, the change in opening degree B1, B2, and B3 may be set so as to be proportional to the difference between the current opening degree and the target opening degree. That is, because the difference between the current opening degree and the target opening degree is large at the initial stage of the control of the opening amount of the expansion valve 141, the change in opening degree according to the opening time is increased, thus achieving more rapid control. Thereafter, the closer the opening degree of the first expansion valve reaches to the target opening degree, the smaller the change in opening degree according to the opening time becomes, thereby achieving more precise control.

Accordingly, in the first control method S50 in accordance with the fourth embodiment of the present invention, the change in opening degree B1, B2, and B3 are determined in consideration of the current opening degree of the first expansion valve, and the opening amount of the first expansion valve 141 is controlled a plurality of times until the current opening degree of the first expansion valve 141 reaches the target opening degree, thus gradually increasing or decreasing the opening degree of the first expansion valve 141. In other words, since amount of the refrigerant gradually increases or decreases, the cycle can be more stabilized.

Meanwhile, if the air conditioner 100 is out of a normal operating range, the control unit 200 switches from the first control method S50 to the safety control method S60 to control the first expansion valve 141.

In the safety control method S60, it is detected whether operating parameters, such as the discharge temperature of the refrigerant discharged from the compressor 110 and the temperature of the refrigerant passed through the indoor heat exchangers 120, are out of a preset normal operating range (S61).

If the operating parameters, such as the discharge temperature of the refrigerant discharged from the compressor 110 and the temperature of the refrigerant passed through the indoor heat exchangers 120, are out of a preset normal operating range, the control unit 200 switches from the first control method S50 to the safety control method S60 to control the first expansion valve 141.

In the safety control method S60, a correction opening degree is determined based on the operating parameter values (S62), and the correction opening degree is combined with the opening degree stored in the first control method S50 (S63) to control the opening amount of the first expansion valve 141 (S64). Afterwards, during the execution of the safety control method S60, the current opening degree of the first expansion valve 141 is stored in real time (S65), and the correction opening degree is combined with the current opening degree stored during the execution of the safety control method S60 to control the opening amount of the first expansion valve 141.

Accordingly, if the operating parameter value of the air conditioner 10 is out of the normal operating range, the control method for the first expansion valve 141 is switched to another method, thereby improving the stability of the system.

Moreover, in the first control method S50, the current opening degree of the first expansion valve 141 is detected and stored, and the opening degree of the first expansion valve 141 is gradually increased or decreased, thus making it easier to switch to another control method during the execution of the first control method 141.

Figure 11:
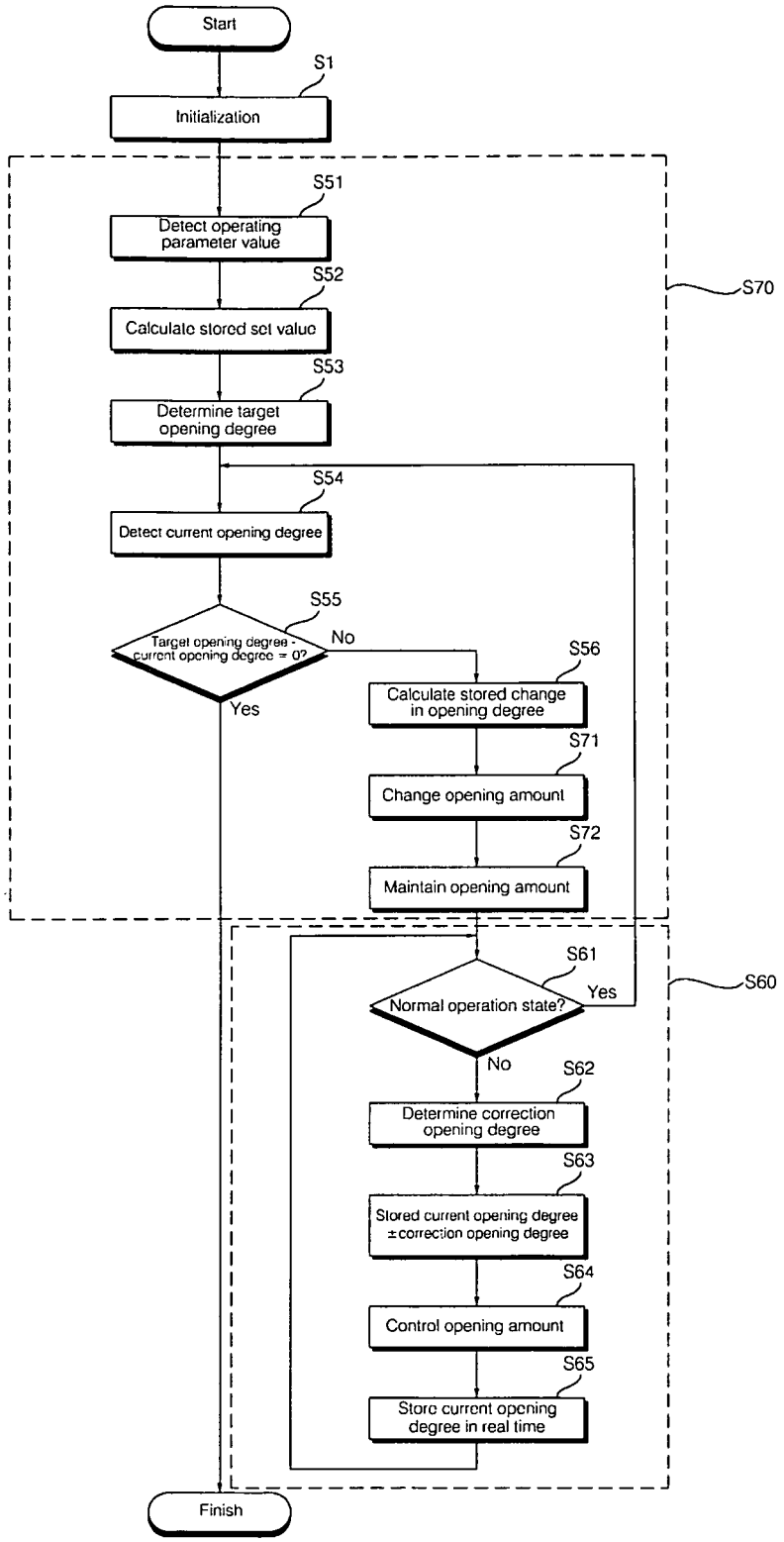
FIG. 11 is a sequential view illustrating a first control method for a first expansion valve when an air conditioner in accordance with a seventh embodiment of the present invention is in a cooling operation mode.

FIG. 11 is a sequential view illustrating a first control method for a first expansion valve when an air conditioner in accordance with a seventh embodiment of the present invention is in a cooling operation mode. The following description focuses on the difference with the sixth embodiment. The same reference numerals as those in the sixth embodiment denote the same members.

The differences with the sixth embodiment include a change process in which the control unit 200 changes the opening degree of the first expansion valve 141 until the opening degree of the first expansion device reaches a target opening degree and a maintenance process in which the control unit 200 maintains a changed opening degree. In other words, when a change in opening degree is determined depending on the difference between the target opening degree and the current opening degree, the opening degree is changed by the change in opening degree (S71). Thereafter, the control of the first expansion valve 141 is stopped, and the opening degree of the first expansion valve 141 is maintained for a predetermined time (S72). The cycle can be more stabilized upon control of the first expansion valve by having the time for changing the opening degree and then maintaining the opening degree.

The change process S71 and the maintenance process S72 may be performed a plurality of times until the current opening degree of the first expansion valve 141 reaches the target opening degree.

Figure 12:
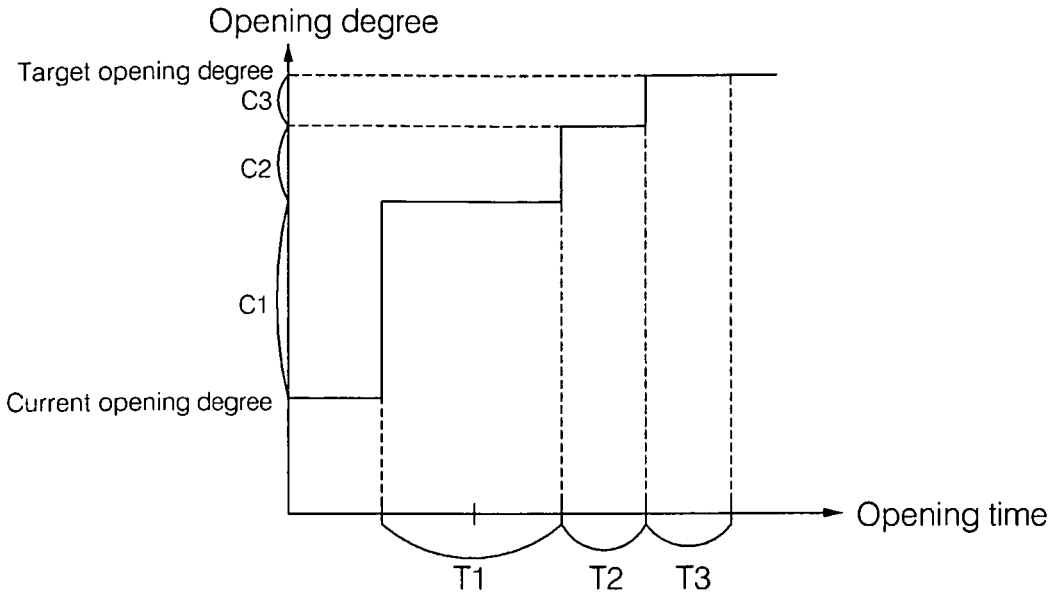
FIG. 12 is a graph showing a change in opening degree according to the opening time of the first expansion valve in accordance with the seventh embodiment of the present invention.

FIG. 12 is a graph showing a change in opening degree according to the opening time of the first expansion valve in accordance with the seventh embodiment of the present invention.

In one example, referring to FIG. 12, the change process S71 and the maintenance process S72 are each carried out three times. In the plurality of times of the change process, a change in opening C1, C2, and C3 is controlled so as to be proportional to opening time. That is, because the difference between the current opening degree and the target opening degree is large at the initial stage of the control of the opening amount of the expansion valve 141, the change in opening degree according to the opening time is increased, thus achieving more rapid control. Thereafter, as the opening time increases and the opening degree of the first expansion valve reaches closer to the target opening degree, the smaller the change in opening degree becomes smaller, thereby achieving more precise control. Also, an opening degree maintenance time T1, T2, and T3 in the plurality of times of the maintenance process is controlled so as to be proportional to opening time. That is, the opening degree maintenance time is set to be long at the initial stage of the opening amount of the first expansion valve 141. Thereafter, as the opening time gradually increases, the opening degree maintenance time T1, T2, and T3 becomes smaller. Moreover, the opening degree maintenance time T1, T2, and T3 may be set so as to be proportional to the change in opening degree C1, C2, and C3 in the change process. Accordingly, the larger the change in opening degree of the first expansion valve 141, the longer the opening degree maintenance time T1, T2, and T3, thereby further stabilizing the cycle upon control of the first expansion valve 141.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. An air conditioning system, comprising:

a condenser for condensing a refrigerant;

a first expansion device for throttling the refrigerant passed through the condenser;

a phase separator connected to the first expansion device for separating the refrigerant passed through the first expansion device into a gaseous refrigerant and a liquid refrigerant;

a second expansion device connected to the phase separator for throttling the liquid refrigerant separated by the phase separator;

an evaporator for evaporating the refrigerant passed through the second expansion device;

a compressor for compressing the refrigerant passed through the evaporator and the gaseous refrigerant injected from the phase separator;

an injection pipe to connect the phase separator and the compressor;

an injection valve disposed on the injection pipe for throttling the gaseous refrigerant separated by the phase separator;

an injection temperature sensor disposed on the injection pipe for sensing an injection temperature of the refrigerant injected from the phase separator;

an evaporating temperature sensor installed in the evaporator for sensing an evaporating temperature;

a compressor inlet temperature sensor installed at an inlet side of the compressor for sensing an inlet temperature of the refrigerant sucked into the compressor; and a control unit for detecting a value of at least one operating parameter and determining a target opening degree of the first expansion device on the basis of a stored set value corresponding to the detected value of the operating parameter, wherein the control unit adjusts an opening degree of the first expansion device until the opening degree of the first expansion device reaches the target opening degree to adjust an intermediate pressure calculated from the injection temperature sensed by the injection temperature sensor, wherein a degree of superheat of the refrigerant is measured in real time, and the control unit continually controls an opening degree of the second expansion device based on the measured degree of superheat, wherein the degree of superheat of the refrigerant is the difference between the inlet temperature sensed by the compressor inlet temperature sensor and the evaporating temperature sensed by the evaporating sensor, wherein the control unit opens the injection valve to inject the gaseous refrigerant separated from the phase separator into the compressor after the control unit adjusts the opening degree of the first expansion device.

2. The air conditioning system of claim 1, wherein the compressor includes:

a first compressing part for compressing the refrigerant passed through the evaporator; and a second compressing part for compressing the refrigerant passed through the first compressing part and the refrigerant injected from the phase separator.

3. The air conditioning system of claim 1, wherein the target opening degree of the first expansion device is determined based on a linear combination of the set values for the operating parameters.

* * * * *